United States Patent [19]

Larsen

[11] 4,252,344

[45] Feb. 24, 1981

[54] COMBINATION SAFETY STRAP AND HANDLE FOR SKI POLES

[76] Inventor: Greg S. Larsen, 10721 Keswick St., Sun Valley, Calif. 91352

[21] Appl. No.: 19,117

[22] Filed: Mar. 9, 1979

[51] Int. Cl.[3] ..... A63C 11/22

[52] U.S. Cl. ..... 280/822; 2/DIG. 6; 224/45 S

[58] Field of Search ..... 280/11.37 E, 11.37 R, 280/11.37 D, 11.37 H, 822, 821; 224/45 S; 2/DIG.6; 24/204

[56] References Cited

U.S. PATENT DOCUMENTS

| | | | |
|---|---|---|---|
| 3,163,436 | 12/1964 | Shride et al. | 280/11.37 H |
| 3,316,669 | 5/1967 | Nachbar | 24/204 |
| 3,433,495 | 3/1969 | Christensen | 280/11.37 H |
| 4,082,303 | 4/1978 | Finnegan | 280/11.37 H |
| 4,139,210 | 2/1979 | Allsop | 280/11.37 H |

FOREIGN PATENT DOCUMENTS

| | | | |
|---|---|---|---|
| 173396 | 5/1951 | Fed. Rep. of Germany | 280/11.37 H |
| 2382250 | 11/1978 | Fed. Rep. of Germany | 280/11.37 H |

*Primary Examiner*—John J. Love
*Assistant Examiner*—D. W. Underwood
*Attorney, Agent, or Firm*—Francis X. LoJacono

[57] ABSTRACT

A combination safety strap and handle for ski poles wherein the strap is arranged to be releasably disconnected from the wrist of a skier under adverse conditions, the strap having at least one end thereof attached directly to the handle member and formed having an enlarged loop, the loop being defined by the strap looped over itself and held in this configuration by means of two opposing, cooperating, fastening-sheet-material tape members which will disconnect under stress, thus freeing the ski pole from the skier.

2 Claims, 5 Drawing Figures

12
36
14
10
18
30
26
28
24
20
32
34
35
16
22
23

36c
62c
75
48
76
82
80
78
74
84
72
23
48
36
38
15
46
14a
44
42
12a
37
40
23
10

12c
10

12b
14b
64
62
36b
70
67
68
10
65
66
60
23

36
38
15
12a
52
48
46
14a
54
42
56
44
51
23
50
10

COMBINATION SAFETY STRAP AND HANDLE FOR SKI POLES

BACKGROUND OF THE INVENTION

1. Field of the Invention

This invention relates generally to a releasable ski-pole-strap means, and more particularly to a safety releasable ski-pole-strap device in combination with a ski-pole handle, wherein the strap is adapted to disconnect from the skier's wrist under adverse conditions and at any angle of stress applied thereto.

2. Description of the Prior Art

As has been established in the art, several problems and difficulties have been and are still being encountered in providing suitable means for releasably attaching ski poles to a skier's wrists, so that they can be readily detached to prevent injury to the skier.

Various types of devices have been unsuccessfully tried, and others are presently being employed that still do not provide the most efficient operable modes, and/or are operable only when stress is placed thereon under specific conditions. Many of these devices are very expensive to manufacture.

As for various examples of the different types of devices of handgrips, break-away handgrips, straps and break-away straps, the following U.S. Pat. Nos. are of interest: 3,378,273; 3,451,688; 3,540,751; 3,982,747 and 3,995,872.

Originally, straps were permanently fastened to the handgrips or to the ski pole itselt. This was to prevent the skiers from losing their ski poles when they fell while skiing. However, the skier soon realized that, if the ski pole were accidently engaged in an obstruction, it could very readily cause injury to a wrist, finger, arm, leg or shoulder, since the strap way unyieldingly anchored to the pole and to the skier's wrist.

Thus, as might be noted by the above-identified patents, many devices have been created to protect the skier. Developments have been made in break-away handgrips and break-away straps; but—due to either complexity of design, expensive material, or high labor costs—they have not generally met with public approval or use. Other units have been designed with mechanical parts that can break, jam-up or become easily lost if the skier takes a hard fall.

A problem with the straps presently on the market is that they do not have suitable releasable-loop configurations to fit the wrist area. Thus, if the skier should accidentally get a tree branch caught in a closed loop, he could possibly be seriously injured. Furthermore, the majority of break-away straps or grips will only release in a certain direction, angle, or axis, from the ski pole—thus, again posing the problem of possible injury to the skier.

SUMMARY OF THE INVENTION

The present invention comprises the combination of a ski-pole handle having a looped strap member attached thereto, wherein the strap is either formed from one or two strip sections. Thus, various strap arrangements can be established, including an adjustable and releasable hook-and-loop tape fastener which comprises a first tape element secured to the inner face of one strip section adjacent the free end thereof, and a second tape element secured to the outer face of the other strip section—or the second tape element will be affixed adjacent to the fixed end of a single strap member that is secured to the handle.

OBJECTIVES AND ADVANTAGES OF THE INVENTION

The present invention has for an important object a single-looped releasable strap that is affixed to a ski-pole handle wherein the strap is provided with a hook-and-loop, releasably engageable tape-fastener means that allows the loop of the strap to break-away, thus freeing the skier's wrist.

It is another object of the invention to provide a combination safety releasable strap and handle for ski poles that is constructed of soft flexible material, forming an elongated strap—wherein one end of the strap is attached to the handle and the free end is looped and releasably fastened to itself.

It is still another object of the invention to provide a ski-pole handle with a releasable strap device that has a predetermined length formed from either a single or a double strap member.

It is a further object of the invention to provide a releasable strap device attached to a ski-pole handle that is relatively inexpensive to manufacture and yet is simple and rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

DESCRIPTION OF THE PREFERRED EMBODIMENT

Figures 1, 2, 3, 4, 5:
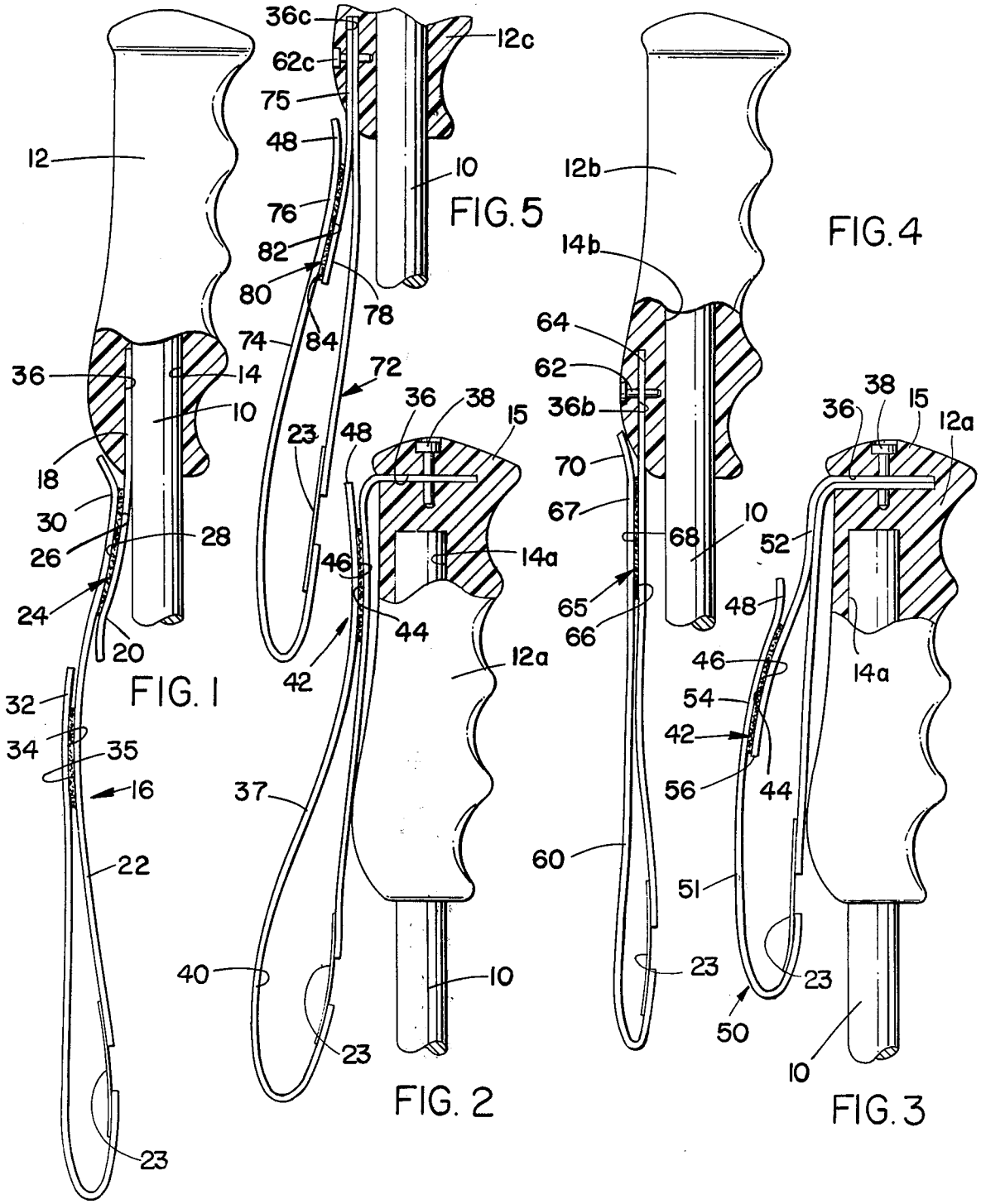
FIG. 1 is a side-elevational view of the upper portion of a ski pole having the handle mounted thereto with a double section looped strap.
FIG. 2 is a side-elevational view of a ski-pole handle having the upper portion thereof broken away, showing a single looped strap member attached thereto.
FIG. 3 is a side-elevational view of that in FIG. 2, wherein the strap is formed in two sections and is attached to the top of the handle.
FIG. 4 shows a single strap member secured to the lower portion of a ski-pole handle.
FIG. 5 is a cross-section of the lower portion of a handle, showing another arrangement of the attached strap.

Referring more particularly to the embodiment of FIG. 1, there is shown an upper end of a ski pole 10, the pole being of any suitable known material, and having a handle 12 generally formed from a hard plastic material and secured to the pole 10; that is, handle 12 is provided with a central longitudinal bore 14 that is adapted to receive the end of pole 10.

A single-looped strap device, indicated generally at 16, is attached to the inner bore 14 and is further held in place by pole 10. Accordingly, the single-looped strap device 16 comprises a pair of strip members, both being formed from a piece of soft, flexible, ribbon-like material, preferably a nylon. The first strip 18 has a predetermined length wherein one end thereof is secured to handle 12 within bore 14, and the opposite end thereof extends outwardly—thus providing a free end 20 to which a second elongated, soft, flexible, ribbon-like strip 22 is releasably connected thereto. The second strip member 22 is also provided with an elastic means comprising an elongated elastic band 23. This allows the loop to be stretched when necessary.

Thus, there is provided a first releasable fastening means, indicated generally at 24, which allows strip 22 to be adjustably and releasably attached to the first strip 18. Said fastening means comprises a pair of hook-and-loop tape elements 26 and 28 which are respectively secured to the opposing free ends of strips 22 and 18. Element 26 is attached to the inner surface of the free end 30 of strip 22; and element 28 is attached to the outer surface of end 20 of strip 18.

From the above first connecting point at 24, the second strip 22 extends longitudinally therefrom wherein said strip 22 is bent back to form an enlarged single loop having the opposite free end 32 thereof adjustably and releasably connected to an intermediate area of the strip between the respective free ends 30 and 32, wherein there is also provided a second adjustable and releasable fastening means—the second fastening means being comprised of the same materials as those of the first fastening means. That is, a first hook-and-loop tape 34 is attached to the inner surface of free end 32, with a second tape member 35 being secured to the outer face of strip 22—thereby the loop adapted to receive a wrist of a skier.

Hence, it can be seen that the embodiment of FIG. 1 provides two releasable connecting points, whereby the second strip member 22 can be completely removed as necessary.

Referring now to a second embodiment as illustrated in FIG. 2, there is shown a ski pole 10 having handle **12*a* which includes the longitudinal bore 14*a*, the bore terminating at a point to leave a closed end portion 15, which will hereinafter be referred to as the head member of handle 12*a*. Thus, head member 15 is provided with an elongated lateral recess 36 in which one end of a single looped strap 37 is secured by any suitable fastening means such as glue, or the like. However, it is contemplated that a screw-like member 38 be threadably disposed in head 15 so as to allow removal of strap 37**, when necessary.

Accordingly, strap 37 extends outwardly from handle **12*a* and has a predetermined length whereby loop 40 can be established so as to be positioned about the skier's wrist. In order to hold loop 40, there is provided a second fastening means, generally indicated at 42, said second fastening means comprising a first hook-and-loop tape member 44 which is attached to strap 37 adjacent the fixed end thereof, and a second mating tape member 46 which is secured to the opposing surface of strap 37, when the loop is formed, and positioned adjacent the free end of strap 37. Strap 37 further includes an extended member 48 which defines a pull tab whereby the mating tape members 44 and 46 can be pulled apart when attaching or detaching the looped strap from one's wrist, and a stretchable elastic band 23*a*** to permit the loop to be enlarged if necessary.

It should be noted that the mating of the two tape members 44 and 46 can be adjusted to couple at various positions so as to enlarge or reduce the loop itself.

Another strap arrangement is illustrated in FIG. 3 which is similar to that of the arrangement in FIG. 2, with the exception that the looped strap, indicated at 50, comprises two strip sections 51 and 52. Section 52 may be a separate second strip or short folded extended strip of strap 50. Thus, both the first and second strip sections are secured in slot 36 wherein fastening means 42 is interposed between the respective free ends 54 and 56 of sections 51 and 52.

Mating tape member 44 is secured to free end 56, and the opposing mating tape member 46 is affixed to free end 54 of strip section 51.

The arrangement of FIG. 4 comprises a ski-pole handle **12*b* including a central bore 14*b*. Disposed within the lower end of handle 12*b* is a vertical slot 36*b* which is adapted to receive one end of strap 60. Strap 60 is secured in slot 36*b* by any suitable means, but is herein shown attached by screw or pin 62 that engages the handle-and-strap end 64. The strap extends outwardly from the bottom of handle 12*b* to a predetermined length, thus allowing a large loop to be formed therewith. That is, strap 60 is folded back and is releasably fastened to itself by fastening means 65, the fastening means comprising two interconnecting tape members 66 and 68—previously described as having mating hook-and-loop members therein so as to be releasably fastened together. Hook-and-loop tape member 66 is secured to the outer free end 67 of strap 60; and the mating tape member 68 is affixed to strap 60 adjacent the handle 12*b*. It should be noted that the free end 67 of the strap further extends to provide a pull-tab member 70** whereby the strap can be manually released.

The last arrangement of the present invention is illustrated in FIG. 5 wherein handle **12*c* also includes a central bore 14*c* to receive ski pole 10 therein. A vertical slot 36*c* is provided in the lower portion of handle 12*c* and is adapted to receive looped strap 72 wherein strap 72 comprises two strip sections 74 and 75. Strip section 74 is a substantially elongated strip of flexible ribbon-like material having one end secured in slot 36*c* of the handle and extending outwardly to help define a large loop. The second strip member is a relatively short piece of material that is also secured in slot 36*c* by means of a screw or pin 62*c*. Thus, both free ends 76 and 78 of respective strip sections 74 and 75 are releasably attached by fastening means 80, wherein the fastening means comprises a pair of hook-and-loop tape members as previously described. One tape member 82 is affixed adjacent free end 76 of strip section 74; and the other tape member 84 is secured to free end 78 of section 75**. Thus, the loop strap can be readily disengaged to allow the skier's wrist to be freed therefrom when force is applied to the pole or the strap itself.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A combination safety strap and handle for ski poles comprising:

a handle having a central bore adapted to be mounted to a ski pole;

a strap member having at least one elongated strip section of soft flexible material interconnected to said handle, and wherein the strap includes at least one free end that is releasably attachable to another point of the strap to define a releasable loop;

wherein the strap member comprises:

a first strip section having a predetermined length wherein one end thereof is secured to said handle, and the opposite end thereof extends outwardly from said handle, providing a free end thereof;

a second elongated soft flexible strip section having oppositely disposed free ends wherein one free end thereof is releasably connected to said free end of said first strip, and said other free end of said second strip section is releasably connected along said second strip to define an adjustable loop thereon;

a first hook-and-loop, releasably engageable fastener means having one mating tape member affixed to said free end of said first strip section, and the other mating tape member thereof affixed to one of said free ends of said second strip member, whereby said first and second strip members are releasably interconnected; and a second hook-and-loop, releasably engageable fastener means having one mating tape member affixed to the other said free end of said second strip member, and said other mating tape member affixed to said second strip member wherein said loop is formed by connecting each of said mating tapes of said second fastener means.

2. A combination safety strap and handle as recited in claim 1, wherein at least one free end of said second strip section includes a pull-tab member for manual release of said fastener means, and an elastic band to allow the loop formed thereby to be expanded.

* * * * *